US008864982B2

(12) United States Patent
Duyvesteyn et al.

(10) Patent No.: US 8,864,982 B2
(45) Date of Patent: Oct. 21, 2014

(54) METHODS FOR OBTAINING BITUMEN FROM BITUMINOUS MATERIALS

(75) Inventors: Willem P. C. Duyvesteyn, Reno, NV (US); Julian Kift, Reno, NV (US); Cherish M. Hoffman, Reno, NV (US); Whip C. Thompson, Reno, NV (US)

(73) Assignee: Shell Canada Energy Cheveron Canada Limited, Calgary Alberta (CA)

( * ) Notice: Subject to any disclaimer, the term of this patent is extended or adjusted under 35 U.S.C. 154(b) by 1244 days.

(21) Appl. No.: 12/648,164

(22) Filed: Dec. 28, 2009

(65) Prior Publication Data

US 2011/0155648 A1 Jun. 30, 2011

(51) Int. Cl.

| | |
|---|---|
| ***C10G 1/04*** | (2006.01) |
| ***C10G 21/02*** | (2006.01) |
| ***C10G 21/14*** | (2006.01) |
| ***C10G 21/16*** | (2006.01) |

(52) U.S. Cl.

CPC ..... *C10G 1/04* (2013.01)
USPC ..... 208/390; 208/323; 208/333; 208/337

(58) Field of Classification Search

USPC ..... 208/323, 333, 337, 390
See application file for complete search history.

(56) References Cited

U.S. PATENT DOCUMENTS

| | | | | |
|---|---|---|---|---|
| 2,871,180 | A | | 1/1959 | Lowman |
| 3,131,141 | A | | 4/1964 | West |
| 3,484,365 | A | | 12/1969 | Pitchford |
| 3,527,692 | A | | 9/1970 | Titus |
| 3,565,593 | A | | 2/1971 | Moore et al. |
| 3,565,594 | A | | 2/1971 | Moore |
| 3,779,902 | A | | 12/1973 | Mitchell et al. |
| 4,035,282 | A | | 7/1977 | Stuchberry et al. |
| 4,046,668 | A | | 9/1977 | Farcasiu et al. |
| 4,054,506 | A | | 10/1977 | Hart, Jr. et al. |
| 4,120,773 | A | | 10/1978 | Ridgway |
| 4,120,777 | A | | 10/1978 | Globus |
| 4,139,450 | A | | 2/1979 | Hanson et al. |
| 4,222,873 | A | | 9/1980 | Parsons |
| 4,224,138 | A | | 9/1980 | Kruyer |
| 4,250,016 | A | | 2/1981 | Estes et al. |
| 4,308,133 | A | | 12/1981 | Meyer |
| 4,347,118 | A | | 8/1982 | Funk et al. |
| 4,455,216 | A | * | 6/1984 | Angevine et al. ..... 208/390 |
| 4,490,259 | A | | 12/1984 | Coffing |
| 4,512,872 | A | | 4/1985 | Chung et al. |
| 4,589,980 | A | | 5/1986 | Keys |
| 4,592,826 | A | | 6/1986 | Ganguli |
| 4,596,651 | A | | 6/1986 | Wolff et al. |
| 4,612,113 | A | | 9/1986 | Kallioinen |
| 4,676,889 | A | | 6/1987 | Hsieh et al. |
| 4,678,561 | A | | 7/1987 | Keys |
| 4,678,562 | A | | 7/1987 | Keys |
| 4,702,487 | A | | 10/1987 | Stoian et al. |
| 4,722,782 | A | | 2/1988 | Graham et al. |
| 4,724,272 | A | | 2/1988 | Raniere et al. |
| 4,744,890 | A | | 5/1988 | Miller et al. |
| 4,846,964 | A | | 7/1989 | Scott et al. |
| 4,859,317 | A | | 8/1989 | Shelfantook et al. |
| 5,044,552 | A | | 9/1991 | Becker et al. |
| 5,084,160 | A | | 1/1992 | Stewart et al. |
| 5,143,598 | A | | 9/1992 | Graham et al. |
| 5,176,802 | A | | 1/1993 | Duyvesteyn et al. |
| 5,223,148 | A | | 6/1993 | Tipman et al. |
| 5,236,577 | A | | 8/1993 | Tipman et al. |
| 5,295,665 | A | | 3/1994 | Mackie |
| 5,389,274 | A | | 2/1995 | Fernandez |
| 5,443,158 | A | | 8/1995 | McKenny et al. |
| 5,485,883 | A | | 1/1996 | Rippetoe et al. |
| 5,520,799 | A | | 5/1996 | Brown et al. |
| 5,534,136 | A | | 7/1996 | Rosenbloom |
| 5,538,081 | A | | 7/1996 | Rippetoe et al. |
| 5,554,301 | A | | 9/1996 | Rippetoe et al. |
| 5,626,743 | A | | 5/1997 | Humphreys |
| 5,626,793 | A | | 5/1997 | Reiffenrath et al. |
| 5,670,056 | A | | 9/1997 | Yoon et al. |
| 5,670,345 | A | | 9/1997 | Srivastava et al. |
| 5,702,612 | A | | 12/1997 | Wang |
| 5,728,202 | A | | 3/1998 | Nelson et al. |
| 5,795,466 | A | | 8/1998 | Kelebek et al. |
| 5,798,137 | A | | 8/1998 | Lord et al. |
| 5,849,201 | A | | 12/1998 | Bradley |

(Continued)

FOREIGN PATENT DOCUMENTS

| | | |
|---|---|---|
| CA | 2224615 | 6/1999 |
| WO | WO 01/32936 | 5/2001 |
| WO | WO 03/072506 | 9/2003 |
| WO | WO 2007/102819 | 9/2007 |
| WO | WO 2011/082209 | 7/2011 |

OTHER PUBLICATIONS

Biodiesel Processing, Mar. 22, 2004 (3 pp.).
Biodiesel Processing, biodiesel Handout for 2005 New Hampshire Science Teacher's Association Workshop UNH Biodiesel Group, http://www.unh.edu/p2/biodiesel, 2005 (27 pp.).
Campbell, National Biodiesel Board 2005 Annual Meeting, Marina Marriott, Ft. Lauderdale, FL, Feb. 1, 2005 (9 pp.).
Cohen et al., "Degradation of Coal by Fungi Polyporus Versicolor and *Poria monticola*," Appl. Enviorn. Microbiol., 44(1):23-27, Jul. 1982 (5 pp.).
Desolventizer-Toaster, Crown Iron Works Company, PDF file created Feb. 16, 2010, (3 pp.).
Gallmetzer et al., "Efflux of Organic Acids in *Penicillium simplicissimum* is an Energy-Spilling Porcess . . . ," Microbiology 148:1143-1149, 2002 (7 pp.).
Houdaille, "Jet Pump Technical Data—Puming Liquids," pp. 1-11, 1982 (12 pp.).

(Continued)

*Primary Examiner* — Randy Boyer

(57) ABSTRACT

A method of extracting bitumen from bituminous material. In some embodiments, the method may include loading a bitumen material in a column, followed by feeding a first quantity of first solvent into the column. The method may also include collecting the bitumen-enriched solvent exiting the column. A quantity of the bitumen-enriched solvent may then be fed into the column. In some embodiments, the method may include simultaneously loading bitumen material and a first solvent in a column, followed by feeding additional first solvent into the column. The method may also include collecting bitumen-enriched solvent exiting the column, and feeding a quantity of the bitumen-enriched solvent into the column.

28 Claims, 5 Drawing Sheets

(56) References Cited

U.S. PATENT DOCUMENTS

| | | | |
|---|---|---|---|
| 5,872,289 | A | 2/1999 | Appleby et al. |
| 5,876,592 | A | 3/1999 | Tipman et al. |
| 5,896,435 | A | 4/1999 | Gautier et al. |
| 5,961,786 | A | 10/1999 | Freel et al. |
| 5,968,349 | A | 10/1999 | Duyvesteyn et al. |
| 5,992,050 | A | 11/1999 | Kemper et al. |
| 6,007,709 | A | 12/1999 | Duyvesteyn et al. |
| 6,036,849 | A | 3/2000 | Rippetoe et al. |
| 6,074,558 | A | 6/2000 | Duyvesteyn et al. |
| 6,106,787 | A | 8/2000 | Rippetoe |
| 6,214,213 | B1 | 4/2001 | Tipman et al. |
| 6,320,148 | B1 | 11/2001 | Yoon et al. |
| 6,352,639 | B2 | 3/2002 | Ito et al. |
| 6,427,843 | B1 | 8/2002 | Clark |
| 6,514,310 | B2 | 2/2003 | Allemand et al. |
| 6,589,417 | B2 | 7/2003 | Taciuk et al. |
| 6,595,163 | B2 | 7/2003 | Dumaz et al. |
| 6,764,542 | B1 | 7/2004 | Lackey et al. |
| 6,768,015 | B1 | 7/2004 | Luxem et al. |
| 6,793,079 | B2 | 9/2004 | Khan et al. |
| 6,822,105 | B1 | 11/2004 | Bernhardt et al. |
| 6,827,786 | B2 | 12/2004 | Lord |
| 6,827,841 | B2 | 12/2004 | Kiser et al. |
| 6,871,743 | B2 | 3/2005 | Yoon |
| 6,936,227 | B1 | 8/2005 | De Souza et al. |
| 6,965,044 | B1 | 11/2005 | Hammond et al. |
| 6,989,091 | B2 | 1/2006 | Jorgensen |
| 7,011,749 | B2 | 3/2006 | Hayes et al. |
| 7,018,435 | B1 | 3/2006 | Wentinck |
| 7,097,675 | B2 | 8/2006 | Detering et al. |
| 7,438,807 | B2 | 10/2008 | Garner et al. |
| 7,464,756 | B2 | 12/2008 | Gates et al. |
| 7,588,682 | B2 | 9/2009 | Norman |
| 7,824,453 | B2 | 11/2010 | Duyvesteyn |
| 7,909,989 | B2 | 3/2011 | Duyvesteyn et al. |
| 7,985,333 | B2 | 7/2011 | Duyvesteyn |
| 8,101,067 | B2 | 1/2012 | Duyvesteyn et al. |
| 8,257,580 | B2 | 9/2012 | Duyvesteyn et al. |
| 2002/0134704 | A1 | 9/2002 | Mitchell et al. |
| 2005/0070218 | A1 | 3/2005 | Phillips et al. |
| 2005/0092682 | A1 | 5/2005 | Phillips et al. |
| 2006/0076274 | A1 | 4/2006 | Duyvesteyn et al. |
| 2006/0144760 | A1 | 7/2006 | Duyvesteyn et al. |
| 2007/0170095 | A1 | 7/2007 | Freel et al. |
| 2007/0209971 | A1 | 9/2007 | Duyvesteyn et al. |
| 2007/0284283 | A1 | 12/2007 | Duyvesteyn et al. |
| 2008/0060257 | A1 | 3/2008 | Duyvesteyn |
| 2008/0156702 | A1 | 7/2008 | Duyvesteyn |
| 2008/0210602 | A1 | 9/2008 | Duyvesteyn |
| 2008/0242875 | A1 | 10/2008 | Hong et al. |
| 2009/0090654 | A1 | 4/2009 | Duyvesteyn et al. |
| 2009/0145809 | A1 | 6/2009 | Ledbetter, Jr. et al. |
| 2009/0294332 | A1 | 12/2009 | Ryu |
| 2009/0301937 | A1 | 12/2009 | Duyvesteyn et al. |
| 2010/0032348 | A1 | 2/2010 | Duyvesteyn et al. |
| 2011/0017642 | A1 | 1/2011 | Duyvesteyn |
| 2011/0062057 | A1 | 3/2011 | Duyvesteyn |
| 2011/0155648 | A1 | 6/2011 | Duyvesteyn et al. |
| 2011/0180458 | A1 | 7/2011 | Duyvesteyn et al. |
| 2011/0180459 | A1 | 7/2011 | Duyvesteyn et al. |
| 2012/0145602 | A1 | 6/2012 | Kift et al. |
| 2012/0145603 | A1 | 6/2012 | Kift et al. |
| 2012/0152809 | A1 | 6/2012 | Kift et al. |
| 2012/0228196 | A1 | 9/2012 | Kift et al. |
| 2012/0305452 | A1 | 12/2012 | Duyvesteyn et al. |
| 2013/0006026 | A1 | 1/2013 | Kift et al. |
| 2013/0025861 | A1 | 1/2013 | Kift et al. |
| 2013/0026076 | A1 | 1/2013 | Kift et al. |
| 2013/0026077 | A1 | 1/2013 | Joshi et al. |
| 2013/0026078 | A1 | 1/2013 | Joshi et al. |

OTHER PUBLICATIONS

Information about Related Patents and Patent Applications.

International Search Report, PCT/US10/43822, Nov. 29, 2010 (4 pp.).

International Search Report, PCT/US10/43082, Sep. 14, 2010 (11 pp.).

International Search Report and Written Opinion, PCT/US09/35552, Apr. 17, 2009 (8 pp.).

International Search Report and Written Opinion, PCT/US07/19222, Apr. 28, 2008 (8 pp.).

International Search Report, PCT/US2005/34092, Jul. 26, 2007 (6 pp.).

Lewis, "Liquefied Petroleum Gas," Hawley's condensed Chemical Dictionary (14th Edition), John Wiley Sons. , 2002 (1 p.).

Rogoff et al., "The Microbiology of Coal," Bureau of Mines, U.S. Dept. of the Interior, Region V, Bruceton, PA, 73:264-268, Aug. 23, 1956 (5 pp.).

Soygold, Environmental Solutions to Your Market Challenges, http://www.soygold.com/applications.htm, printed Mar. 6, 2007 (2 pp.).

Vicente et al., "A Comparative Study of Vegetable Oils for Biodiesel Production in Spain," Energy & Fuels, 20:394-398, 2006 (published on Web Nov. 8, 2005) (5 pp.).

International Search Report and Written Opinion dated Aug. 30, 2011 for PCT Application No. PCT/US2010/062133, 9 pp.

U.S. Appl. No. 12/964,612, filed Dec. 9, 2010, Process for Extracting Bitumen and Drying the Tailings.

U.S. Appl. No. 12/956,701, filed Nov. 30, 2010, Methods for Extracting Bitumen from Bituminous Materials.

U.S. Appl. No. 12/692,127, filed Jan. 22, 2010, Methods fro Extracting Bitumen from Bituminous Material.

International Search Report, PCT/US2010/62133, Aug. 30, 2011 (3 pp.).

U.S. Appl. No. 13/273,975, filed Oct. 14, 2011, Process for Extracting Bitumen and Drying the Tailings.

U.S. Appl. No. 12/692,127, filed Jan. 22, 2010, Methods for Extracting Bitumen from Bituminous Material.

Acetone MSDS, Sigma-Aldrich, Apr. 19, 2012 (8 pp.).

Benzene MSDS, Sigma-Aldrich, Apr. 27, 2012 (9 pp.).

Flores III, Heavy Oil Upgrading, Technology Today, Spring 2010 (6 pp.).

Toluene MSDS, Sigma-Aldrich, Apr. 24, 2012 (8 pp.).

U.S. Appl. No. 13/559,124, filed Jul. 26, 2012, Methods for Extracting Bitumen from Bituminous Material.

U.S. Appl. No. 13/558,041, filed Jul. 25, 2012, Methods and Apparatus for Bitumen Extraction.

U.S. Appl. No. 13/557,842, filed Jul. 25, 2012, Methods and Systems for In-Situ Extraction of Bitumen.

U.S. Appl. No. 13/557,503, filed Jul. 25, 2012, Methods for Obtaining Bitumen from Bituminous Materials.

U.S. Appl. No. 13/418,044, filed Mar. 12, 2012, Methods of Preparing Bituminous Material for Bitumen Extraction.

U.S. Appl. No. 13/584,333, filed Aug. 13, 2012, Methods and Systems for In-Situ Extraction of Bitumen.

U.S. Appl. No. 13/584,432, filed Aug. 13, 2012, Process for Extracting Bitumen and Drying the Tailings.

U.S. Appl. No. 13/584,677, filed Aug. 13, 2012, Dry, Stackable Tailings and Methods for Producing the Same.

U.S. Appl. No. 13/593,045, filed Aug. 23, 2012, Methods and Systems for Upgrading Hydrocarbon.

U.S. Appl. No. 13/524,303, filed Jun. 15, 2012, Methods of Transporting Various Bitumen Extraction Products and Compositions Thereof.

Sinnott, R.K., Chemical Engineering Design. vol. 6, 4th ed., p. 402. Elsevier, 2005 (2 pp.).

International Search Report from International Application No. PCT/US2006/08263.

International Search Report from International Application No. PCT/US2005/36728.

Hong, P.K. Andrew, et al., "A Polar-Nonpolar, Acetic Acid/Heptane, Solvent Medium for Degradation of Pyrene by Ozone", Ind. Eng. Chem. Res. 2004, vol. 43, pp. 7710-7715.

* cited by examiner

METHODS FOR OBTAINING BITUMEN FROM BITUMINOUS MATERIALS

BACKGROUND

Bitumen is a heavy type of crude oil that may be found in naturally occurring geological materials such as tar sands, black shales, coal formations, and weathered hydrocarbon formations contained in sandstones and carbonates. Some bitumen may be described as flammable brown or black mixtures or tarlike hydrocarbons derived naturally or by distillation from petroleum. Bitumen can be in the form of anywhere from a viscous oil to a brittle solid, including asphalt, tars, and natural mineral waxes. Substances containing bitumen are often referred to as bituminous, e.g., bituminous coal, bituminous tar, or bituminous pitch. At room temperature, the flowability of some bitumen is much like cold molasses. Bitumen may be processed to yield oil and other commercially useful products, primarily by cracking the bitumen into lighter hydrocarbon material.

As noted above, tar sands represent one of the well known sources of bitumen. Tar sands typically include bitumen, water and mineral solids. The mineral solids typically include inorganic solids such as coal, sand, and clay. Tar sand deposits are found in many parts of the world, including North America. One of the largest tar sands deposits is in the Athabasca region of Alberta, Canada. In the Athabasca region, the tar sands formation can be found at the surface, although it may also be buried two thousand feet below the surface overburden or more. Tar sands deposits are measured in barrels equivalent of oil. It is estimated that the Athabasca tar sands deposit contains the equivalent of about 1.7 to 2.3 trillion barrels of oil. Global tar sands deposits have been estimated to contain up to 4 trillion barrels of oil. By way of comparison, the proven worldwide oil reserves are estimated to be about 1.3 trillion barrels.

The bitumen content of tar sands can vary widely. In some tar sands, the bitumen content ranges from approximately 3 wt % to 21 wt %, with a typical content of approximately 12 wt %. Accordingly, an initial step in deriving oil and other commercially useful products from bitumen typically requires extracting bitumen from the naturally occurring geological material so that the bitumen may then be upgraded. In the case of tar sands, this may include separating the bitumen from the mineral solids and other components of tar sands.

SUMMARY

Disclosed are embodiments of a method for obtaining bitumen from bituminous materials. In some embodiments, the method for obtaining bitumen from bituminous materials may include extracting bitumen from bituminous material loaded in a vertical column. The bituminous material may be loaded in the vertical column without the need for a solvent mixing pretreatment step, which may thereby simplify the method and reduce the overall cost of performing the method.

In some embodiments, the method may include loading bitumen material in a column. The method may also include feeding a first quantity of first solvent into the column. Additionally, the method may include collecting bitumen-enriched solvent exiting the column. Furthermore, the method may include feeding a quantity of the bitumen-enriched solvent into the column.

In some embodiments, the method may include simultaneously loading bitumen material and a first solvent in a column. The method may also include feeding additional first solvent into the column. Additionally, the method may include collecting bitumen-enriched solvent exiting the column. Furthermore, the method may include feeding a quantity of the bitumen-enriched solvent into the column.

It is to be understood that the foregoing is a brief summary of various aspects of some disclosed embodiments. The scope of the disclosure need not therefore include all such aspects or address or solve all issues noted in the background above. In addition, there are other aspects of the disclosed embodiments that will become apparent as the specification proceeds.

The foregoing and other features, utilities, and advantages of the subject matter described herein will be apparent from the following more particular description of certain embodiments as illustrated in the accompanying drawings. In this regard, it is to be understood that the scope of the invention is to be determined by the claims as issued and not by whether given subject includes any or all features or aspects noted in this Summary or addresses any issues noted in the Background.

BRIEF DESCRIPTION OF THE DRAWINGS

The preferred and other embodiments are disclosed in association with the accompanying drawings in which.

DETAILED DESCRIPTION

Before describing the details of the various embodiments herein, it should be appreciated that the terms "solvent," "a solvent" and "the solvent" can include one or more than one individual solvent compound unless expressly indicated otherwise. Mixing solvents that include more than one individual solvent compound with other materials can include mixing the individual solvent compounds simultaneously or serially unless indicated otherwise. It should also be appreciated that the term "tar sands" includes oil sands. The separations described herein can be partial, substantial or complete separations unless indicated otherwise. All percentages recited herein are weight percentages unless indicated otherwise.

Tar sands are used throughout this disclosure as a representative bitumen material. However, the methods disclosed herein are not limited to processing of tar sands. Any bitumen material may be processable by the methods disclosed herein.

Figure 1:
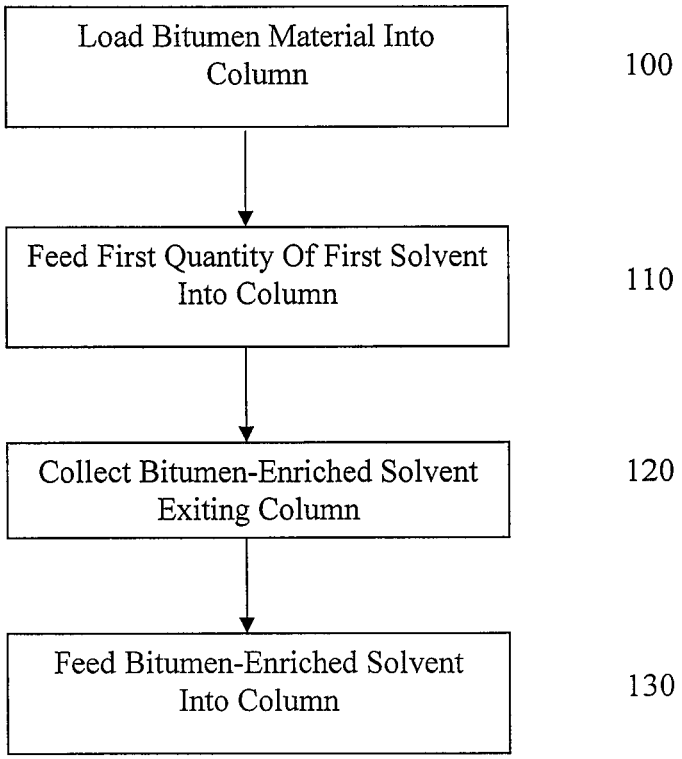
FIG. 1 is a flow chart detailing a method for obtaining bitumen from bituminous material as disclosed herein.

With reference to FIG. 1, a first embodiment of a method for obtaining bitumen from bituminous materials includes a step 100 of loading bitumen material in a column, a step 110 of feeding a first quantity of first solvent into the column, a step 120 of collecting bitumen-enriched solvent exiting the column, and a step 130 of feeding the bitumen-enriched solvent into the column.

With reference to the step 100 of loading bitumen material in a column, the bitumen material can be any material that includes at least some bitumen content. Exemplary bitumen materials include, but are not limited to, tar sands, black shales, coal formations, and hydrocarbon sources contained in sandstones and carbonates. The bitumen material can be obtained by any known methods for obtaining bitumen material, such as by surface mining or underground mining. The bitumen content of the bitumen material suitable for use in this method is also not limited.

The column into which the bitumen material is loaded can be any type of column suitable for carrying out bitumen extraction on bituminous material. In some embodiments, the column has a generally vertical orientation. The vertical orientation may include aligning the column substantially perpendicular to the ground, but also may include orientations where the column forms angles less than 90° with the ground. In some embodiments, the column can oriented at an angle anywhere within the range of from about 1° to 90° with the ground. In a preferred embodiment, the column is oriented at an angle anywhere within the range of from about 15° to 90° with the ground.

The material of construction for the vertical column is also not limited. Any material that will hold the bitumen material within the column can be used. The material may also preferably be a non-porous material such that various solvents fed into the column may only exit the column from one of the ends of the vertical column. The material can be a corrosive-resistant material so as to withstand the potentially corrosive components fed into the column as well as any potentially corrosive materials.

The shape of the column is not limited to a specific configuration. Generally speaking, the column can have two ends opposite one another, designated a top end and a bottom end. The cross-section of the column can be any shape, such as a circle, oval, square, rectangle, or the like. In some embodiments, the cross-section of the column changes along the height of the column, including both the shape and size of the column cross-section. The column can be a straight line column having no bends or curves along the height of the vertical column. Alternatively, the column can include one or more bends or curves.

A wide variety of dimensions can be used for the column, including the height, inner cross sectional diameter and outer cross sectional diameter of the column. In some embodiments, the ratio of height to inner cross sectional diameter ranges from 0.25:1 to 15:1.

The bitumen material can be loaded in the column according to any suitable method. For example, in some embodiments, the bitumen material is generally loaded in the column by introducing the bitumen material into the column at the top end of the column. The bottom end of the column can be blocked, such as by a removable plug or by virtue of the bottom end of the column resting against the floor. In some embodiments, a metal filter screen at the bottom end of the column can be used to maintain the bitumen material in the vertical column. In such configurations, introducing the bitumen material at the top end of the column fills the column with bitumen material.

In some embodiments, the bitumen material is loaded into the column by pouring the bitumen material into the top end of the column. In one example, the bitumen material can be transported to the column via a conveyor having one end positioned over the top end of the column. In such a configuration, the bitumen material falls into the column after it is transported over the end of the conveyor positioned over the column. Manual methods of loading bitumen material into the column can also be used, such as mechanical or manual shoveling the bitumen material into column. For larger diameter columns, automatic distribution systems can be used, such as the systems disclosed in U.S. Pat. Nos. 4,555,210 and 6,729,365.

The amount of bitumen material loaded in the column may be such that the bitumen material substantially fills the column with bitumen material. In some embodiments, the bitumen material may be added to the column to occupy 90% or more of the volume of the column. In some embodiments, the bitumen material may not be filled to the top of the column so that room is provided to feed solvent into the column.

Generally speaking, the loading of bitumen material into the column as described above will lead to a well packed column. That is to say, the bitumen material will settle into the vertical column in manner that results in minimal void spaces within vertical column. If the vertical column is not well packed (i.e., includes too many void spaces or overly large void spaces), solvent added to the column to dissolve and extract bitumen (a step of the method described in greater detail below) will flow through the vertical column too quickly. When solvent passes through the bitumen material too quickly, an insufficient amount of solvation of bitumen occurs and a generally poor extraction process results.

In some embodiments, additional steps may be taken to ensure a packed column of bitumen material and thereby promote sufficient solvation of bitumen when solvent is passed through the bitumen material loaded in the column. In some embodiments, the size of individual pieces of the bitumen material can be reduced prior to loading the bitumen material into the column. Reducing the size of the pieces of the bitumen material may help the pieces of the bitumen material settle closer to each other in the column and avoid the formation of void spaces or overly large void spaces. The pieces of bitumen material can be reduced in size by any suitable procedure, such as by crushing or grinding the pieces. In some embodiments, the pieces are reduced in size based on the diameter of the column used. In some embodiments, the pieces are reduced to a size that is 15% or less than the diameter of the column. For example, when the column has a diameter of 40 inches, the pieces can be reduced to a size of 6 inches or less.

In other embodiments, the bitumen material can be packed down once it is loaded in the column in order to reduce or eliminate void spaces. Any method of packing down the bitumen material may be used. In some embodiments, a piston or the like is inserted into the top end of the vertical column and force is applied to the piston to move the piston downwardly into the column in order to pack down the bitumen material. The piston may apply pressure downwardly on the bitumen material loaded in the column as a consistent application of downward pressure or as a series of downward blows. Alternatively, a vibration device, such as the device disclosed in U.S. Pat. No. 3,061,278 can be used to pack down the bitumen material. Packing down of the bitumen material can also be performed manually. Additionally, packing may be allowed to occur under its own weight, including after solvent has been added to the bitumen material. After solvent has been added to the bitumen material and the bitumen has become partially solvated, the mixture of solvent and bitumen material can compact and slump down under its own weight. After the bitumen material is packed down once, additional bitumen material can be added to the column to take up the space in the column created by the packing. The packing down of bitumen material and adding of further bitumen material can be repeated one or more times.

In step 110, a first quantity of first solvent is fed into the column. One objective of adding first solvent to the column is to dissolve the bitumen content of the bitumen material loaded in the column. Put another way, the first solvent is added to the column to reduce the viscosity of the bitumen and allow it to flow through and out of the column. Without the solvent, the bitumen content of the bitumen material at room temperature may have a viscosity in the range of 100,000 times that of water and will not flow through the column. The addition of the solvent reduces the viscosity of the bitumen to a flowable state and allows it to travel out of the column with the first solvent.

Accordingly, the first solvent used in step 110 can be any suitable solvent for dissolving or reducing the viscosity of the bitumen in the bitumen material. In some embodiments, the first solvent includes a hydrocarbon solvent. Any suitable hydrocarbon solvent or mixture of hydrocarbon solvents can be used. In some embodiments, the hydrocarbon solvent is a hydrocarbon solvent that does not result in asphaltene precipitation. The hydrocarbon solvent or mixture of hydrocarbon solvents can be economical and relatively easy to handle and store. The hydrocarbon solvent or mixture of hydrocarbon solvents may also be generally compatible with refinery operations.

In certain embodiments, the first solvent is a light aromatic solvent. The light aromatic solvent can be an aromatic compound having a boiling point temperature less than about 400° C. at atmospheric pressure. In some embodiments, the light aromatic solvent used in the first mixing step is an aromatic having a boiling point temperature in the range of from about 75° C. to about 350° C. at atmospheric pressure, and more specifically, in the range of from about 100° C. to about 250° C. at atmospheric pressure. In some embodiments, the light aromatic solvent has a boiling temperature less than about 200° C.

It should be appreciated that the light aromatic solvent need not be 100% aromatic compounds. Instead, the light aromatic solvent may include a mixture of aromatic and non-aromatic compounds. For example, the first solvent can include greater than zero to about 100 wt % aromatic compounds, such as approximately 10 wt % to 100 wt % aromatic compounds, or approximately 20 wt % to 100 wt % aromatic compounds.

Any of a number of suitable aromatic compounds can be used as the first solvent. Examples of aromatic compounds that can be used as the first solvent include benzene, toluene, xylene, aromatic alcohols and combinations and derivatives thereof. The first solvent can also include compositions, such as kerosene, diesel (including biodiesel), light gas oil, light distillate, commercial aromatic solvents such as Solvesso 100, Solvesso 150, and Solvesso 200 (also known in the U.S.A. as Aromatic 100, 150, and 200, including mainly $C_{10}$-$C_{11}$ aromatics, and produced by ExxonMobil), and/or naphtha. In some embodiments, the first solvent has a boiling point temperature of approximately 75° C. to 375° C. Naphtha, for example, is particularly effective at dissolving bitumen and is generally compatible with refinery operations.

The first solvent added into the column need not be 100% first solvent. Other components can be included with the first solvent when it is added into the column. In some embodiments, the first solvent added into the column include a bitumen content. The first solvent might include a bitumen content when the first solvent added into the column in step 110 is first solvent that has already been used to extract bitumen from a bitumen material. As described in greater detail below, first solvent that passes through bitumen material in a column may exit the column as bitumen-enriched solvent, and this bitumen-enriched solvent may be used to carry out step 110 being performed on a different column packed with bitumen material. For example, bitumen-enriched solvent collected from the bottom of a first column as described in greater detail below may be added to bitumen material loaded in a second column in order to carry out step 110 in the second column.

The first solvent can be fed into the column in a wide variety of ways. For example, in some embodiments, solvent is injected into the bitumen material loaded in the column at various locations along the height of the column. Such injection may be accomplished through the use of column side injectors that are spaced along the height of the column and extend through the side wall of the column and into the interior of the column where the bitumen material is loaded. Injection of solvent at various locations along the height of the column can also be accomplished by using a single pipe that extends down into the column and includes various locations along the length of the pipe where solvent can exit the pipe. The pipe can be positioned down the center of the column or off to the side of the column.

In configurations such as those described above, the solvent may be injected into the column beginning with the lowest injection positions first and moving upwardly through the column. Injecting solvent into the column in this manner and in this order helps to ensure percolation of solvent through the column and prevents the column from plugging up as described in greater detail below.

Figure 5:
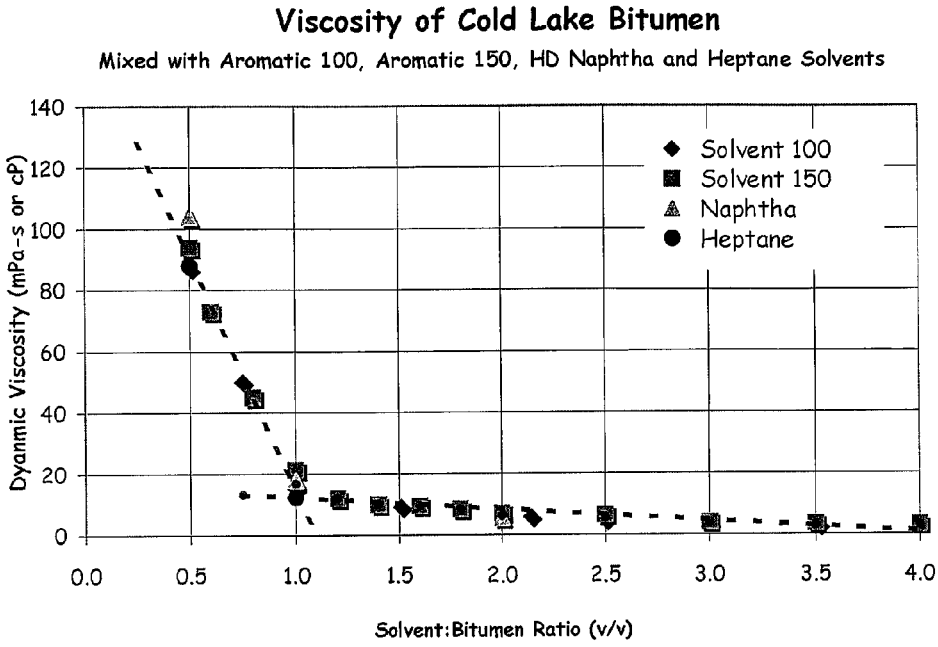
FIG. 5 is a graph showing the relationship between the S:B ratio and the dynamic viscosity of bitumen when using various types of solvents.

With reference to FIG. 5, it has been determined that the amount of the first solvent added to the column can be any amount where the ratio of solvent to the bitumen content of the bitumen material (on a v/v basis) (herein referred to as "S:B") is greater than 1. If a S:B ratio less than 1 is used, the viscosity of the bitumen in the first solvent is not sufficiently reduced to provide for an adequate flow of bitumen through the packed column. As shown in FIG. 5, the viscosity of the bitumen in the first solvent sharply increases as the S:B ratio falls below 1, thereby making S:B ratios less than 1 unsuitable for the method described herein. Conversely, the viscosity of the bitumen only gradually decreases as the S:B ratio rises above 1, thereby making S:B ratios greater than 1 suitable for use in the method described herein.

As discussed above, the first solvent can be injected into the column starting from the bottom of the column and moving upwards to the top of the column. Injecting the solvent into the column in this manner may beneficially prevent the column from plugging by ensuring that the S:B ratio does not fall below 1 at any location inside the column. If first solvent is added at the top of the column at an S:B ratio of 1, a portion of the solvent may flow down the column to a location where the S:B ratio is below 1 and therefore does not sufficiently reduce the viscosity of the bitumen to flow through the column. This may result in the column plugging up. By introducing the solvent at an S:B ratio of at least 1 at the bottom of the column and subsequently and sequentially adding solvent at higher positions along the column at an S:B ratio greater than 1, portions of the injected solvent may not be able to flow downwardly to a location in the column where the S:B ratio is not greater than 1 and plug the column. Accordingly, the manner of injecting the solvent into the column described in greater detail above may avoid problems related to column plugging.

If the column does become plugged due to the S:B ratio falling below 1 at a location within the column, steps can be taken to unplug the column. More specifically, the location of the plug can be identified and additional solvent can be injected into the column at the injection point just below the plug (when the column is operated in a downward flow mode). The additional solvent injected into the column can be injected into the column in such a manner as to close off the bottom of the column and force the solvent to flow upwardly though the column. For example, increasing the flow rate and pressure of the injected solvent may result in closing off the bottom of the column. The upwardly moving solvent may then displace and dissolve the bitumen phase causing the plug due to the viscosity issues.

The first solvent fed into the column flows downwardly through the bitumen material loaded in the column. The first solvent flows downwardly through the height of the column via small void spaces in the bitumen material. The first solvent may travel the flow of least resistance through the first mixture. As the first solvent flows through the bitumen material, the first solvent can dissolve bitumen contained in the bitumen material and thereby form bitumen-enriched solvent. In some embodiments, 90%, preferably 95%, and most preferably 99% or more of the bitumen in the bitumen material is dissolved in the first solvent and becomes part of the bitumen-enriched solvent phase.

With continuing reference to FIG. 1, in some embodiments the first quantity of first solvent added into the packed column at step 110 is added into the packed column in two stages. In a first stage, a portion of the first quantity of the first solvent added to the packed column serves primarily to reduce the viscosity of the bitumen content of the bitumen material loaded in the column and create a dissolved bitumen (also known as "disbit") phase that may flow downwardly and out of the column. In a second stage, the remaining portion of the first quantity of first solvent added to the packed column serves primarily to displace out of the column any disbit that did not flow out of the column with the rest of the disbit formed upon the addition of the first portion of the first quantity of first solvent.

The division of the first quantity of first solvent into a first stage amount and a second stage amount is not limited. In some embodiments, from about 30% to about 75% of the first quantity of first solvent makes up the first stage amount of first solvent and from about 25% to about 70% of the first quantity of first solvent makes up the second stage amount of the first solvent.

As noted above, the material leaving the column upon addition of the first stage amount of first solvent includes bitumen dissolved in first solvent. In some embodiments, the bitumen-enriched solvent leaving the column includes from about 25% to about 75% bitumen and from about 25% to about 75% first solvent.

The material leaving the column upon addition of the remaining portion of the first quantity of first solvent can also include bitumen dissolved in first solvent, but the amount of bitumen in the first solvent may be significantly less than in the bitumen-enriched solvent leaving the column after the addition of the first stage of first solvent. This is due to the relatively minor amount of disbit remaining in the column after the addition of the first stage of the first solvent and the relatively high amount of first solvent added to the column as the remaining portion of the first quantity of the first solvent. In some embodiments, the material leaving the column after the addition of the remaining portion of the first quantity of first solvent includes from about 60% to about 95% first solvent and from about 5% to about 40% bitumen.

The material leaving the column during the two stage addition of the first solvent can be collected separately so the two streams do not intermix. The bitumen-enriched solvent collected first can be collected and treated as final product rather than being recycled back into the column. The material collected second can be used as the bitumen-enriched solvent that is recycled back into the column in step 130 described in greater detail below.

The bitumen-enriched solvent that flows downwardly through the height of the column may exit the column at, for example, the bottom end of the column. Accordingly, a step 120 of collecting the bitumen-enriched solvent exiting the column is performed. Any method of collecting the bitumen-enriched solvent can be used, such as by providing a collection vessel at the bottom end of the column. The bottom end of the column can include a metal filter screen having a mesh size that does not permit bitumen material to pass through but which does allow for bitumen-enriched solvent to pass through and collect in a collection vessel located under the screen. Collection of bitumen-enriched solvent can be carried out for any suitable period of time. In some embodiments, collection is carried until the bitumen-enriched solvent phase substantially or completely stops exiting the column. In some embodiments, collection is carried out for from 2 to 60 minutes.

In some embodiments, the bitumen-enriched solvent collected in step 120 contains from about 10 wt % to about 60 wt % bitumen and from about 40 wt % to about 90 wt % first solvent. Minor amounts of non-bitumen material can also be included in the bitumen-enriched solvent phase.

In some embodiments, a portion of the first solvent fed into the column does not travel all the way through the column. Rather, a portion of the first solvent is trapped in the bitumen material loaded in the column. The first solvent trapped in the bitumen material may or may not have bitumen dissolved therein. In some embodiments, the material loaded in the column after bitumen-enriched solvent phase has been collected includes from about 75 wt % to about 95 wt % non-bitumen components of the bitumen material, from about 4 wt % to about 20 wt % first solvent and from 1 wt % to 5 wt % bitumen. Accordingly, after addition of first solvent as in step 110, the material loaded in the column can be considered first solvent-wet tailings.

In some embodiments, the flow of first solvent through the column and the removal of bitumen-enriched solvent phase is aided by adding a pressurized gas into the column either before or after first solvent is fed into the column. Applying a pressurized gas over the bitumen material loaded in the column can facilitate the separation of the bitumen-enriched solvent from the non-bitumen components of the bitumen material loaded in the vertical column. Once liberated and having a much reduced viscosity due to the addition of the solvent, the bitumen-enriched solvent phase can be pushed out of the column either by the continual addition of pressurized gas or by feeding additional first solvent into the column. The addition of additional first solvent or bitumen-enriched solvent collected in step 120 can displace the liberated bitumen-enriched solvent from the first solvent-wet tailings by providing a driving force across a filtration element (i.e., the non-bituminous components of the bitumen material). Any suitable gas may be used. In some embodiments, the gas is nitrogen, carbon dioxide or steam. The gas can also be added over the bitumen material loaded in the vertical column in any suitable amount. In some embodiments, 1.8 $m^3$ to 10.6 $m^3$ of gas per ton of bitumen material is used. This is equivalent to a range of about 4.5 liters to 27 liters of gas per liter of bitumen material. In certain embodiments, 3.5 $m^3$ of gas per ton of bitumen material is used.

After collecting bitumen-enriched solvent, a step 130 of feeding the collected bitumen-enriched solvent back into the column is performed. The bitumen-enriched solvent phase can be fed into the column in a similar or identical manner as described above with respect to feeding a first quantity of first solvent into the column. The bitumen-enriched solvent may be fed back into the column "as is" or may be diluted with additional first solvent prior to feeding the bitumen-enriched solvent back into the column. The amount of bitumen-enriched solvent phase fed into the column is not limited. In some embodiments, the bitumen-enriched solvent fed into the column is approximately 0.5 to 3.0 times the amount of bitumen by volume contained in the original bitumen material.

In some embodiments, the bitumen-enriched solvent fed into the column behaves much like the first quantity of first solvent fed into the column. The bitumen-enriched solvent flows downwardly through the column, dissolving additional bitumen still contained in the column and forcing any entrapped bitumen-enriched solvent out of the column. The bitumen-enriched solvent eventually may exit the column, where it may be collected in a similar or identical manner to the collection step 120 described above.

The steps of collecting bitumen-enriched solvent and feeding bitumen-enriched solvent back into the column can be repeated one or more times in order to remove greater amounts of bitumen from the bitumen material loaded in the column. In some examples, the steps of collecting the bitumen-enriched solvent and feeding the bitumen-enriched solvent into the column are repeated until less than 1 wt % bitumen of the bitumen material is remaining in the column.

After the steps of collecting the bitumen-enriched solvent phase and feeding the bitumen-enriched solvent phase into the column have been performed, additional steps may be taken to clean the first solvent-wet tailings remaining in the column of any residual first solvent contained therein. In some embodiments, the cleaning steps may include feeding a second solvent into the column capable of displacing any residual first solvent remaining in the column.

In some embodiments, the second solvent fed into the column is a solvent having a higher vapor pressure than the first solvent to enhance removal of the second solvent in subsequent processing steps. The second solvent can be in a liquid or gaseous state when fed into the column. In some embodiments, the second solvent is a hydrocarbon solvent. Any suitable hydrocarbon solvent or mixture of hydrocarbon solvents that is capable of displacing the first solvent may be used. The hydrocarbon solvent or mixture of hydrocarbon solvents can be economical and relatively easy to handle and store. The hydrocarbon solvent or mixture of hydrocarbon solvents may also be generally compatible with refinery operations. Other second solvents suitable for use are described in co-pending U.S. application Ser. No. 12/560,964, herein incorporated by reference.

In some embodiments, the second solvent is a polar solvent. The polar solvent can be an oxygenated hydrocarbon. Oxygenated hydrocarbons include any hydrocarbons having an oxygenated functional group. Oxygenated hydrocarbons include alcohols, ketones and ethers. Oxygenated hydrocarbons as used in the present application do not include alcohol ethers or glycol ethers.

Suitable alcohols for use as the polar solvent include methanol, ethanol, propanol, and butanol. The alcohol can be a primary (e.g., ethanol), secondary (e.g., isopropyl alcohol) or tertiary alcohol (e.g., tert-butyl alcohol).

As noted above, the polar solvent can also be a ketone. Generally, ketones are a type of compound that contains a carbonyl group (C═O) bonded to two other carbon atoms in the form: R1(CO)R2. Neither of the substituents R1 and R2 may be equal to hydrogen (H) (which would make the compound an aldehyde). A carbonyl carbon bonded to two carbon atoms distinguishes ketones from carboxylic acids, aldehydes, esters, amides, and other oxygen-containing compounds. The double-bond of the carbonyl group distinguishes ketones from alcohols and ethers. The simplest ketone is acetone, CH3-CO—CH3 (systematically named propanone).

Adding second solvent to the column can be carried out in any suitable manner that results in first solvent displacement from the material loaded in the column. In some embodiments, second solvent is added to the column in a similar or identical manner to the addition of first solvent into the column as described in greater detail above, including the use of external forces to promote the downward flow of the second solvent through the material loaded in the column and the repeated addition of second solvent into the column.

The amount of the second solvent added to the column cab be sufficient to effectively displace at least a portion, or desirably all, of the first solvent entrapped in the material loaded in the column, including entrained first solvent having bitumen dissolved therein. The amount of second solvent added to the column may be approximately 0.5 to 4 times the amount of bitumen by volume originally contained in the bitumen material.

In some embodiments, the addition of second solvent to the column results in the removal of 95% or more of the first solvent entrapped in the first solvent-wet tailings. The first solvent may leave the column as a first solvent-second solvent mixture. The first solvent-second solvent mixture can include from about 5 wt % to about 50 wt % first solvent and from about 50 wt % to about 95 wt % second solvent, and may also have a relatively minor bitumen content. The first solvent-second solvent mixture can be collected and subjected to further processing to separate the two components, such as by boiling off the second solvent from the first solvent. In the case where the second solvent is a polar solvent, the polar solvent can be separated by any of the methods disclosed in co-pending U.S. application Ser. No. 12/560,964.

As with the possible two stage addition of first solvent described in greater detail above, the second solvent can also be added to the column in two stages. More specifically, the second solvent can be added as a liquid in a first stage and as a superheated gas in a second stage. The addition of second solvent as a liquid in the first stage can result in the displacement of a majority of the first solvent from the column as described above and can result in a first solvent-second solvent mixture exiting the column. The addition of second solvent as a superheated gas in the second stage may behave much like the pressurized gas optionally injected into the column as described in greater detail above. The superheated gaseous second solvent may remove any entrained first solvent-second solvent mixture still located in the column after the first stage addition of second solvent. Additionally, the superheated second solvent may heat first and second solvent (from the first stage) contained in the column and convert these solvents to a vapor to help in the removal of the first and second solvent from the column. Accordingly, the material leaving the column upon introduction of the second stage of second solvent into the column may include both liquid first and second solvents displaced by the superheated second solvent and gaseous first and second solvents that were vaporized by the superheated second solvent. Additionally, some of the superheated second solvent may condense as it passes through the column, and therefore some of the superheated solvent added into the column as part of the second stage may exit the column as a condensed liquid.

The removal of the first solvent from the material loaded in the column through the addition of second solvent can result in a quantity of second solvent not passing all the way through the column. In some embodiments, the material loaded in the column includes from about 70 wt % to about 95 wt % non-bitumen components and from about 5 wt % to about 30 wt % second solvent after second solvent has been added to displace first solvent. Accordingly, after the addition of the second solvent to the first solvent-wet tailings, the first solvent-wet tailings may become second solvent-wet tailings.

The second solvent can be removed from the second solvent-wet tailings loaded in the column to thereby produce solvent-dry, stackable tailings. Any manner of removing second solvent from the second solvent-wet tailings loaded in the column may be used. In some embodiments, the second solvent is removed by drying, flashing or heating the second solvent-wet tailings loaded in the column. In certain embodiments, second solvent is separated and recovered at an elevated temperature or reduced pressure to above or below atmospheric pressure to recover the secondary solvent depending on the solvent flash point. For example, the process may include flashing off a gaseous second solvent under controlled pressure let down or vacuum recovery of a less volatile secondary solvent without the need for elevated temperature.

The removal of second solvent from the second solvent-wet tailings loaded in the column can occur before or after the second solvent-wet tailings loaded in the column is discharged from the column. For example, when removal of second solvent occurs while the second solvent-wet tailings is still loaded in the column, heat can be applied to the column in order to remove the second solvent. Alternatively, the second solvent-wet tailings can be discharged from the column followed by the application of heat to the discharged second solvent-wet tailings to remove the second solvent.

The removal of second solvent may include recovering the second solvent for reuse in the above method. Such recovery can include condensing the evaporated second solvent back into a liquid form.

Once the second solvent is removed, a solvent-dry, stackable tailings is produced. The solvent-dry, stackable tailings may generally include inorganic solids, such as sand and clay, water content, and little or no solvent. In some embodiments, the solvent-dry, stackable tailings are considered solvent-dry because they include less than 0.1 wt % total solvent. Similarly, the solvent-dry, stackable tailings may be considered stackable because they include a water content in the range of from 2 wt % to 15 wt %. This range of water content may reduce or eliminate the problem of tailings dust during transportation and deposition of the tailings. Further, this range or water content may provide for solvent-dry, stackable tailings that may be deposited without requiring retention infrastructure to maintain the tailings in place. The solvent-dry, stackable tailings can include less than 2 wt % bitumen and asphaltene.

Figure 2:
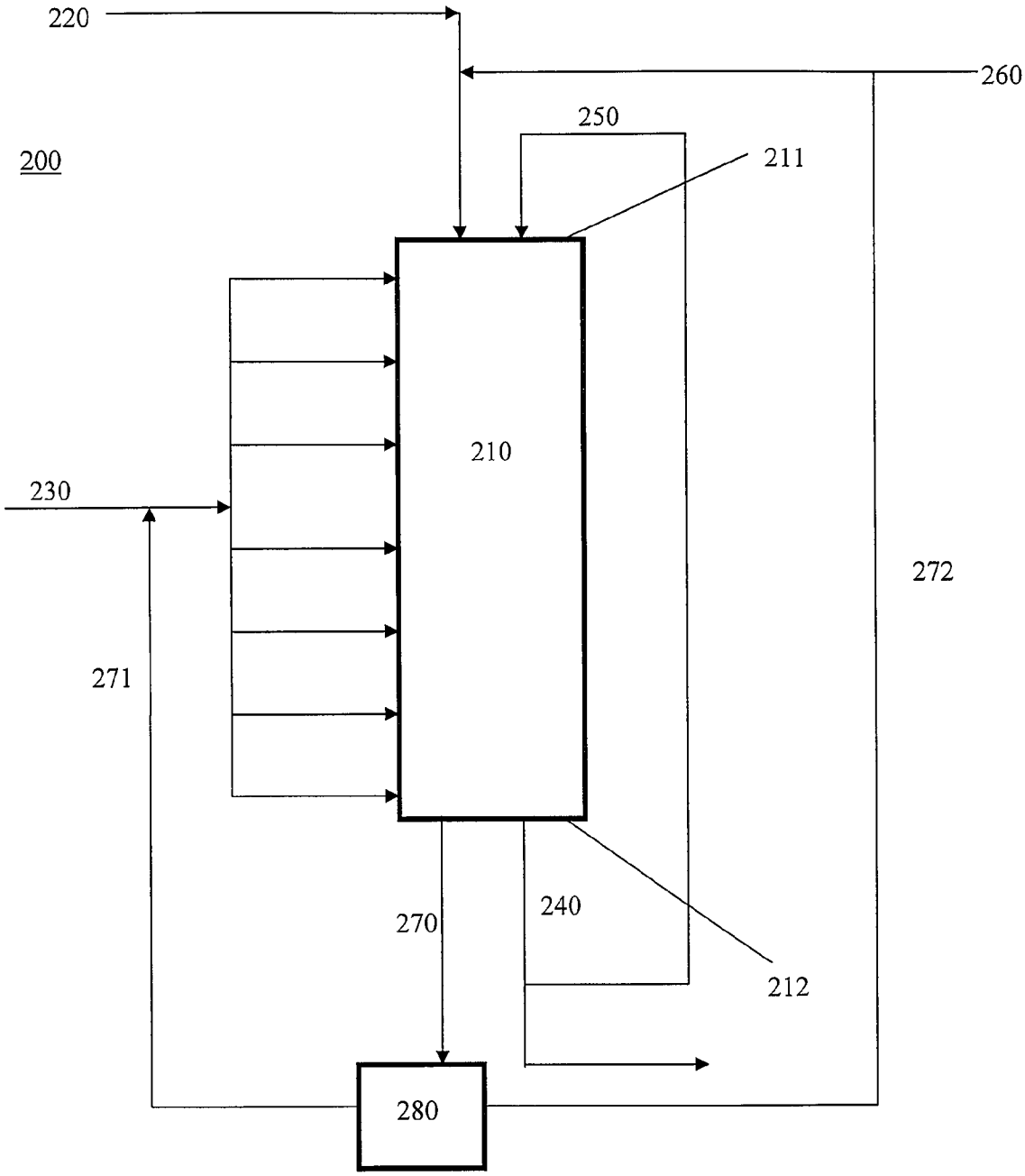
FIG. 2 is a schematic diagram for a system and method for obtaining bitumen from bituminous material as disclosed herein.

With reference to FIG. 2, a system 200 for carrying out the method described above is illustrated. The system includes a column 210 in which bitumen extraction takes place. The column 210 can be vertically oriented and have a top end 211 and a bottom end 212 opposite the top end 211. Bitumen material 220 can fed into the top end 211 of the column 210, such as by using a conveyor having one end positioned over the top end 211 of the column 210 to convey bitumen material 220 into the column 210. After bitumen material 220 is fed into the column 210, the bitumen material 220 can optionally be packed down into the column 210, such as by applying downward force to a piston positioned in the column 210. Additional bitumen material 220 can be fed into the column 210 and packed down into the column 210 after the initial loading and packing down steps have taken place.

A first quantity of first solvent 230 is then be fed into the column 210. As shown in FIG. 2, the first solvent 230 is injected into the column 210 from the side of the column 210 at several positions along the height of the column 210. Injection of the first solvent 230 can begin at the lowest injection point and proceed upwardly to the upper most injection point. Injection of the first solvent 230 can also take place in two stages. The first solvent 230 dissolves bitumen contained in the bitumen material 220 as the first solvent 230 flows downwardly through the column 210. A bitumen-enriched solvent 240 exits the column 210 at the bottom end 212 of the column 210, where it is collected. The collected bitumen-enriched solvent 240 is fed back into the column 210 (with or without the addition of further first solvent) as a recycle stream 250 in order to extract further bitumen from the bitumen material 220. The collection and recycling of bitumen-enriched solvent 240 back into the column 210 can be performed one or more times. Once a sufficient number of recycling cycles has taken place, the bitumen-enriched solvent 240 is collected and separated into bitumen and first solvent. The first solvent can be reused in the method, such as a make-up stream to the first solvent 230 fed into the column, and the bitumen can be subjected to further processing to upgrade the bitumen into commercially useful product.

A portion of the first solvent 230 remains in the now bitumen-depleted bitumen material 220 loaded in the column 210. The first solvent 230 remaining in the column is removed from the column by feeding second solvent 260 into the top end 211 of the column 210 or in a similar manner as the first solvent 230 was injected into the column 210 (i.e., from the side of the column and in an upwardly fashion). Like first solvent 230, the second solvent 260 may be added to the column 210 in two stages, including where the second solvent 260 is added into the column 210 as a superheated gas in the second stage. The second solvent 260 displaces first solvent 230 out of the column 210 as it flows downwardly through the column 210. A first solvent-second solvent mixture 270 exits at the bottom end 212 of the column 210, where it is collected and transported to a separation unit 280. The separation unit 280 separates the first solvent-second solvent mixture 270 into a first solvent 271 and a second solvent 272, and both the first solvent 271 and the second solvent 272 can be reused in the method, such as make-up streams for the first solvent 230 and second solvent 260 fed into the column 210.

A portion of the second solvent 260 remains in the now bitumen-depleted bitumen material 220 loaded in the column 210. The second solvent 260 is removed from the now bitumen-depleted bitumen material 220 by heating the column 210 or heating the now bitumen-depleted bitumen material after it has been discharged from the column 210. The second solvent 260 evaporates off of the now bitumen-depleted bitumen material 220 and may be collected, re-condensed, and reused.

In some embodiments, a method for extracting bitumen from bituminous material includes simultaneously loading bitumen material and first solvent into a column. Such a method may mitigate or eliminate drainage problems relating to viscous bitumen-enriched solvent being unable to flow downwardly through initially dry bitumen material loaded in the column.

Figure 3:
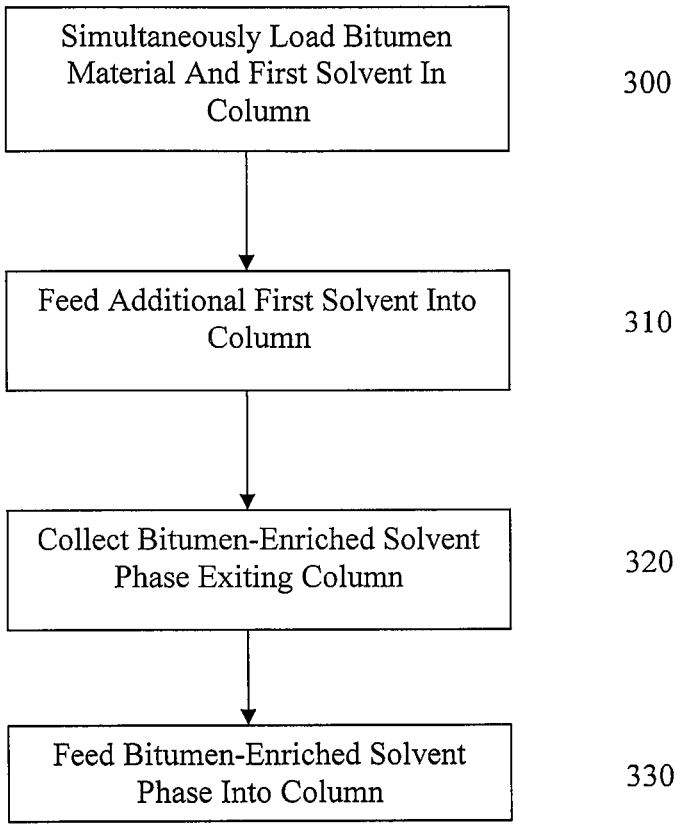
FIG. 3 is a flow chart detailing a method for obtaining bitumen from bituminous material as disclosed herein.

With reference to FIG. 3, the method includes a step 300 of simultaneously loading bitumen material and first solvent in a column, a step 310 of feeding additional first solvent into the column, a step 320 of collecting bitumen-enriched solvent exiting the column, and a step 330 of feeding the bitumen-enriched solvent into the column.

With respect to step 300, the bitumen material and the first solvent can be identical to the bitumen material and the first solvent described in greater detail above, including the use of first solvent having some bitumen content. Similarly, the column into which the bitumen material and the first solvent are simultaneously loaded can be identical to the column described in greater detail above.

The manner in which the bitumen material and the first solvent are loaded into the column can be similar or identical to the loading and feeding described above in greater detail. In some embodiments, the bitumen material is loaded into the column from a top end of the column while the first solvent is injected into the column from the side of the column at several positions along the height of the column. In this manner, bitumen material dropping into the column is intersected by solvent entering the column from several side injection ports located along the height of the column.

The simultaneous introduction of the bitumen material and the first solvent into the column can include any loading procedure where at least a portion of the first solvent and a portion of the bitumen material are loaded into the column at the same time. In some embodiments, the first solvent and the bitumen material are only loaded into the column at the same time. However, in other embodiments, the addition of bitumen material and first solvent need not be simultaneous throughout the entire loading process. A portion of the first solvent can be fed into the column prior to also adding bitumen material into the column, and a portion of the bitumen material can be fed into the column prior to also adding the first solvent into the column. Furthermore, additional first solvent can be fed into the column after the addition of bitumen material has ceased, and additional bitumen material can be fed into the column after the addition of first solvent has ceased.

Generally speaking, the amount of first solvent fed into the column as part of step 300 is based on the S:B ratio described in greater detail above. In some embodiments, the S:B ratio for this embodiment ranges from about 0.75 to about 4.0, and more preferably from about 0.95 to about 1.5. Like the previously described method, S:B ratios in this range ensure that viscosity of the bitumen components of the bitumen material are sufficiently decreased to provide for the flow of the bitumen in the solvent out of the column.

As described above in greater detail, the method may include steps to ensure a packed column with minimal void spaces. Such steps can include a reduction in the size of the pieces of the bitumen material prior to loading the bitumen material in the column.

The simultaneous addition of first solvent and bitumen material into the column results in the first solvent dissolving bitumen contained in the bitumen material and creating bitumen-enriched solvent. The addition of the solvent to the bitumen may reduce the viscosity of the bitumen and make it flowable as part of the bitumen-enriched solvent. Accordingly, bitumen-enriched solvent created by the simultaneous addition of the solvent and the bitumen material can flow out of the column as part of step 300. This bitumen-enriched solvent can be collected and set aside as a final product rather than recycling this bitumen-enriched solvent back into the column.

After step 300, the method of extracting bitumen may proceed in a similar fashion to the method described above in greater detail. Step 310 of feeding an additional amount of first solvent into the column may proceed in a similar fashion to step 110 described above in greater detail. The additional first solvent can be the same first solvent as used in step 310 or another first solvent capable of dissolving bitumen. The additional first solvent can be fed into the column in any suitable manner, such as by injecting the first solvent into the column from the side of the column at multiple locations along the height of the column. The amount of additional first solvent fed into the column can be at a S:B ration in the range of from about 0.75 to about 2.5.

As with the addition of first solvent in step 110, the additional first solvent fed into the column in step 310 flows downwardly through the column. The additional first solvent dissolves bitumen contained in the bitumen material (and not already dissolved during step 300) and displaces any bitumen-enriched solvent that did not flow out of the column during or after step 300. The addition of additional first solvent in step 310 can result in bitumen-enriched solvent exiting the column at the bottom end of the column. In some embodiments, the bitumen-enriched solvent exiting the column as part of step 310 has a bitumen content lower than the bitumen content of the bitumen-enriched solvent exiting the column during or after step 300. This may be due to there being a relatively minor amount of bitumen-enriched solvent still remaining in the column after step 300 and the relatively high amount of first solvent added into the column as part of step 310.

Additionally, as described in greater detail above, external forces can be used to promote the downward flow of the additional first solvent through the column or promote the liberation and displacement of dissolved bitumen. For example, as described in greater detail above, a pressurized gas can be added to the column before or after an amount of first solvent has been added to the column to help promote bitumen extraction.

In step 320, the bitumen-enriched solvent that exits the column during the method is collected. Step 320 may be similar or identical to step 130 described in greater detail above. Any suitable method for collecting the bitumen-enriched solvent can be used, and collection can be carried out for any suitable period of time.

In step 330, bitumen-enriched solvent collected in step 320 is fed back into the column to further extract bitumen remaining in the column. Step 330 may be similar or identical to step 130 described in greater detail above. The bitumen-enriched solvent fed back into the column flows downwardly through the column to dissolve bitumen not dissolved in step 310 or displace bitumen-enriched solvent entrapped in the material loaded in the column. The bitumen-enriched solvent exiting the column as a result of feeding previously collected bitumen-enriched solvent back into the column is collected and either recycled back into the column to promote further bitumen extraction or subjected to separation and upgrading. Repeated reintroduction of bitumen-enriched solvent into the column to achieve further bitumen extraction may result in removal of about 90%, more preferably about 95%, and most preferably about 99% of the bitumen contained in the bitumen material.

As discussed in greater detail above, some first solvent remains in the column after collection of bitumen-enriched solvent has been completed. In order to remove this first solvent from the now bitumen-depleted bitumen material loaded in the column, a second solvent is fed into the column to displace first solvent out of the column. The second solvent may be similar or identical to the second solvent described above in greater detail. In some embodiments, the second solvent is a polar solvent, such as a $C_5$ or lower alcohol. The second solvent can also be added to the column in a two stages as described in greater detail above. The mixture of first solvent and second solvent exiting the column as a result of feeding second solvent into the column is collected and separated into first solvent and second solvent. In this manner, the first and second solvents can be reused in the process. The separation of the mixture of first and second solvent may be similar or identical to the separation processes described in greater detail above.

Any second solvent remaining in the column after second solvent has been fed into the column can be removed from the now bitumen-depleted bitumen material to ultimately produce solvent-dry, stackable tails. In some embodiments, the second solvent is removed by heating the column to evaporate off the second solvent. Heat may also be applied to the now bitumen-depleted bitumen material after it has been discharged from the column. Any second solvent evaporated off the now bitumen-depleted bitumen material may be captured, re-condensed and reused.

Figure 4:
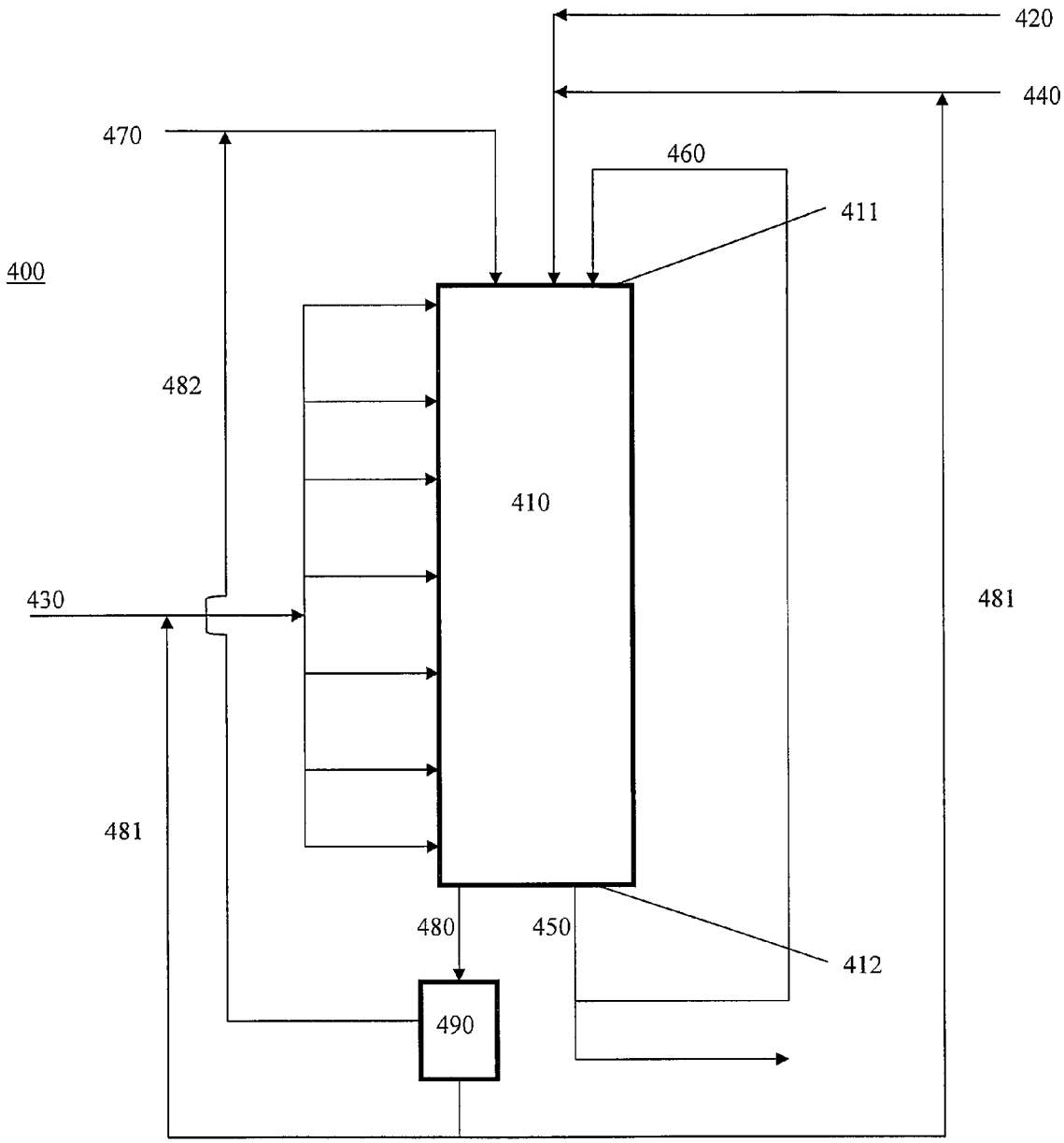
FIG. 4 is a schematic diagram for a system and method for obtaining bitumen from bituminous material as disclosed herein.

With reference to FIG. 4, a system 400 for carrying out the method described above is illustrated. The system includes a column 410 in which bitumen extraction may take place. The column 410 may be vertically oriented and have a top end 411 and a bottom end 412 opposite the top end 411. Bitumen material 420 and a first quantity of first solvent 430 is simultaneously fed into column 410. In so doing, the bitumen material 420 and the first solvent 430 mix together to form a mixture of bitumen material and first solvent that occupies the column 410.

After the first solvent 430 and the bitumen material 420 have been loaded in the column 410, an additional quantity of first solvent 440 is fed into the column 410, such as through side injection described in greater detail above. The additional first solvent 440 flows downwardly through the column 410 to dissolve any bitumen in the column 410 not dissolved during the initial loading of the bitumen material 420 and the first quantity of first solvent 430 and to displace any bitumen-enriched solvent created during the initial loading of the bitumen material 420 and the first quantity of first solvent 430 but which has not flowed out of the column 410 during the simultaneous addition of the first solvent 430 and the bitumen material 420. Ultimately, a bitumen-enriched solvent 450 exits the column 410 at the bottom end 412 of the column 410, where it is collected. The collected bitumen-enriched solvent 450 is fed back into the column 410 as a recycle stream 460 in order to extract any undissolved bitumen or displace any entrapped bitumen-enriched solvent. The collection and recycling of bitumen-enriched solvent 450 back into the column 410 can be performed one or more times. Once a sufficient number of recycling cycles has taken place, the bitumen-enriched solvent 450 is collected and separated into bitumen and first solvent. The first solvent may be reused in the method, such as a make-up stream to the first solvent 430 fed into the column 410, and the bitumen may be subjected to further processing to upgrade the bitumen into commercially useful product.

A portion of the first solvent 430/440 remains in the now bitumen-depleted bitumen material 420 loaded in the column 410. The first solvent 430/440 remaining in the column 410 is removed from the column 410 by feeding second solvent 470 into the top end 411 of the column 410. The second solvent 470 displaces first solvent 430/440 out of the column 410 as it flows downwardly through the column 410. Initially, the material displaced out of the column 410 may be only first solvent 430/440. Eventually, a first solvent-second solvent mixture 480 exits at the bottom end 412 of the column 410, where it is collected and transported to a separation unit 490. The separation unit 490 separates the first solvent-second solvent mixture 480 into a first solvent 481 and a second solvent 482, and both the first solvent 481 and the second solvent 482 can be reused in the method, such as make-up streams for the first quantity of first solvent 430 or the additional first solvent 440 and the second solvent 470 fed into the column 410.

A portion of the second solvent 470 remains in the now bitumen-depleted bitumen material 420 loaded in the column 410. The second solvent 470 is removed from the now bitumen-depleted bitumen material 420 by heating the column 410 or heating the now bitumen-depleted bitumen material 420 after it has been discharged from the column 410. The second solvent 470 evaporates off of the now bitumen-depleted bitumen material 420 and may be collected, re-condensed, and reused.

EXAMPLES

Example 1

Downflow Configuration

A 15 ft tall cylindrical column having an inner diameter of 6 inches and an outer diameter of 6.625 inches (equivalent to a pipe Schedule 10) was positioned perpendicular to the ground and a 120-mesh screen was positioned at the bottom end of the column. Ten kilograms of a clean residue of tar sands was deposited through the top end of the column by hand after removal of the top flange. The deposited clean residue occupied approximately 10% of the volume of the column after deposition.

Ten kilograms of Athabasca oil sands ore with a bitumen content of 12.5% was placed in the column on top of the clean residue. One kilogram of Aromatic 150 was added on top of the oil sands ore. The solvent readily filtered though the oil sands ore and was retained in the column. This process of adding 10 kg of oil sands ore followed by adding 1 kg of Aromatic 150 was repeated until a total of 100 kg of oil sands ore was added to the column. The top flange was placed back on the column. The solvent addition represented a S:B ratio of 0.90 on a v/v basis.

A further amount of Aromatic 150 was introduced into the column through an inlet on the top flange at a rate of 0.67 liters per minute. The amount of Aromatic 150 added represented a S:B ratio of about 1.20 This process took approximately 18 minutes to complete.

Nitrogen was added to the top of the column and maintained at a pressure of 20 psig until all of the free and dissolved bitumen plus Aromatic 150 was driven out of the column. This process took approximately 3 hours. After this nitrogen displacement, methanol was introduced to the column through the inlet in the top flange at a rate of 1.33 liters per minute. This represented a 2:1 methanol to original bitumen ratio by mass. It took approximately 15 minutes to pump in the methanol.

Nitrogen at a pressure of 20 psig was again added, for approximately 2 hours, to the top of the column to drive out any remaining dissolved bitumen in any remaining Aromatic 150 as well as the methanol. The bottom of the column was then removed and clean tailings were discharged.

Mass balance information as well as bitumen recoveries are presented in the following table:

| Test No DSX-384 | Mass kg | Bitumen kg | Aromatic 150 kg | Methanol kg | Bitumen Recovery Stage | Bitumen Recovery Cumulative |
|---|---|---|---|---|---|---|
| Feed | 110 | 12.1 | 23 | 13.8 | | |
| First Wash | 16.5 | 5 | 11.5 | 0 | 41.3% | 41.3% |
| Second Wash | 10 | 2.9 | 7.1 | 0 | 20.6% | 61.9% |
| Third Wash | 6.7 | 0.5 | 3.9 | 1 | 11.9% | 73.8% |
| Tailings | | 1.6 | 0 | 12 | | 86.8% |

This example demonstrates that a large fraction of the bitumen can be recovered when using a column in down flow and a packed bed configuration.

Example 2

Upflow Configuration

A cylindrical column as described in Example 1 was provided, except the column had a 6 inch internal diameter, a height of 6 feet (equivalent to Schedule 10 steel pipe). The flange on the bottom of the column had a ½ inch port, which was used for solvent inlet and outlet. The bottom flange was covered with a 120-mesh screen. The top flange had three ½ inch ports which were used for the wash solvent inlet, nitrogen inlet, and as a pressure relief valve.

The top flange on the column was removed and 10 kg of a clean residue of tar sands was placed in the column on top of the 120-mesh screen. Thirty kilograms of ore with a bitumen content of about 12% was placed in the column on top of the clean residue. This resulted in about 90% of the volume of the column being occupied. The top flange was placed back on the column.

Aromatic 150 was introduced into the column through the inlet on the bottom flange in an up flow mode at a rate of 0.67 liters per minute. This amounted to an S:B ratio of 4:1. This process took approximately 25 minutes to complete.

Nitrogen was added to the top of the column and maintained at a pressure of 20 psig until all of the dissolved bitumen in Aromatic 150 was driven out of the column. This process took approximately 30 minutes. This dissolved bitumen in Aromatic 150 was collected and then pumped back into the column again through the bottom inlet at a rate of 0.67 liters per minute. This process was repeated three times.

After a final nitrogen displacement, a 2:1 methanol to bitumen ratio by mass was introduced to the column through the inlet in the top flange at a rate of 1.33 liters per minute. It took approximately 15 minutes to pump in the methanol.

Twenty psig of nitrogen was again added to the top of the column to drive out any remaining dissolved bitumen in Aromatic 150 as well as the methanol. This step was carried out for approximately 30 minutes.

The residual dissolved bitumen plus Aromatic 150 phase was displaced with methanol and this combined residual bitumen-Aromatic 150-methanol mixture was pumped back into the top of the column at a rate of 1.33 liters per minute which upon the washing completion was again driven out with 20 psig of nitrogen. This methanol washing procedure was repeated once.

The bottom of the column was removed and clean tailings were discharged.

Mass balance information as well as bitumen recoveries are presented in the following table:

| Test No DSX-384 | Mass kg | Bitumen kg | Aromatic 150 kg | Methanol kg | Bitumen Recovery Stage | Bitumen Recovery Cumulative |
|---|---|---|---|---|---|---|
| Feed | 40 | 4.9 | 14.1 | 7.1 | | |
| First Wash | 13 | 3 | 10 | 0 | 61.2% | 61.6% |
| Second Wash | 8.3 | 1.2 | 3.6 | 3.6 | 24.5% | 85.7% |
| Tailings | | 0.5 | 0 | 2.9 | | 89.8% |

This example demonstrates that an upflow column can be an effective way of recovering bitumen from oil sands utilizing a double solvent system. This example also demonstrates how converting the column into an upflow configuration and providing an upflow stream may unplug a column plugged by slow flowing or highly viscous material (due to insufficient solvent).

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A method comprising:

loading bitumen material in a column;

feeding a first quantity of first solvent into the column;

collecting bitumen-enriched solvent exiting the column; and feeding a quantity of the bitumen-enriched solvent into the column.

2. The method as recited in claim 1, wherein the bitumen material is oil sands.

3. The method as recited in claim 1, wherein the column is a vertically-oriented column comprising a top end and a bottom end opposite the top end.

4. The method as recited in claim 3, wherein loading bitumen material in a column comprises loading bitumen material into the top end of the vertically oriented column.

5. The method as recited in claim 1, wherein feeding a first quantity of first solvent into the column comprising feeding the first quantity of first solvent into the column at two or more locations spaced along a length of the column.

6. The method as recited in claim 1, wherein feeding a first quantity of first solvent into the column comprises feeding a first portion of the first quantity of the first solvent into the column followed by feeding a remaining portion of the first quantity of the first solvent into the column.

7. The method as recited in claim 1, wherein the first solvent comprises a light aromatic solvent.

8. The method as recited in claim 7, wherein the light aromatic solvent comprises Aromatic 100, Aromatic 150 or mixtures thereof.

9. The method as recited in claim 1, wherein the first quantity of first solvent is 1 or more times a bitumen quantity of the bitumen material loaded in the column on v/v basis.

10. The method as recited in claim 1, wherein the steps of collecting bitumen-enriched solvent exiting the column and feeding a quantity of the bitumen-enriched solvent into the column are repeated one or more times.

11. The method as recited in claim 1, further comprising: feeding a first quantity of polar solvent into the column after feeding the quantity of the bitumen-enriched solvent into the column.

12. The method as recited in claim 11, wherein the polar solvent comprises a $C_5$ or lower alcohol.

13. The method as recited in claim 11, wherein feeding a first quantity of polar solvent into the column after feeding the quantity of the bitumen-enriched solvent into the column comprises feeding a first portion of the first quantity of the polar solvent into the column as a liquid followed by feeding a remaining portion of the first quantity of the polar solvent into the column as a superheated gas.

14. The method as recited in claim 11, further comprising: heating the column after feeding the polar solvent into the column.

15. The method as recited in claim 1, further comprising: packing down the bitumen material loaded in the column prior to feeding a first quantity of first solvent into the column.

16. The method as recited in claim 1, further comprising: reducing in size individual pieces of the bitumen material prior to loading the bitumen material in the column.

17. A method comprising:

simultaneously loading bitumen material and a first solvent in a column;

feeding additional first solvent into the column;

collecting bitumen-enriched solvent exiting the column; and feeding a quantity of the bitumen-enriched solvent into the column.

18. The method as recited in claim 17, wherein the bitumen material is oil sands.

19. The method as recited in claim 17, wherein the column is a vertically oriented column comprising a top end and a bottom end opposite the top end.

20. The method as recited in claim 17, wherein simultaneously loading bitumen material and a first solvent in a column comprises loading bitumen material into the top end of the vertically oriented column and feeding the first solvent into the column at two or more locations spaced along a length of the column.

21. The method as recited in claim 17, wherein the first solvent comprises a light aromatic solvent.

22. The method as recited in claim 21, wherein the light aromatic solvent comprises Aromatic 100, Aromatic 150, or mixtures thereof.

23. The method as recited in claim 17, wherein the first solvent fed into the column is 1 or more times a bitumen quantity of the bitumen material loaded in the column on v/v basis.

24. The method as recited in claim 17, wherein the steps of collecting bitumen-enriched solvent exiting the column and feeding the bitumen-enriched solvent into the column are repeated one or more times.

25. The method as recited in claim 17, further comprising: feeding a first quantity of polar solvent into the column after feeding the quantity of the bitumen-enriched solvent into the column.

26. The method as recited in claim 25, wherein the polar solvent comprises a $C_5$ of lower alcohol.

27. The method as recited in claim 25, wherein feeding a first quantity of polar solvent into the column after feeding the quantity of the bitumen-enriched solvent into the column comprises feeding a first portion of the first quantity of the polar solvent into the column as a liquid followed by feeding a remaining portion of the first quantity of the polar solvent into the column as a superheated gas.

28. The method as recited in claim 25, further comprising: heating the column after feeding the polar solvent into the column.

* * * * *